US005637014A

United States Patent [19]

Sukegawa et al.

[11] Patent Number: 5,637,014

[45] Date of Patent: Jun. 10, 1997

[54] ELECTRICAL CONNECTOR

[75] Inventors: Akihito Sukegawa; Yuji Tsujii, both of Ibaraki, Japan

[73] Assignee: Mitsumi Electric Co., Ltd., Tokyo, Japan

[21] Appl. No.: 378,249

[22] Filed: Jan. 24, 1995

[30] Foreign Application Priority Data

Jan. 31, 1994 [JP] Japan ..... 6-029000
Jan. 31, 1994 [JP] Japan ..... 6-029001

[51] Int. Cl.[6] ..... H01R 13/00

[52] U.S. Cl. ..... 439/607; 439/609

[58] Field of Search ..... 439/607–610, 439/95, 108

[56] References Cited

U.S. PATENT DOCUMENTS 5,017,158 5/1991 Liu et al. ..... 439/609
5,022,871 6/1991 Sekiguchi ..... 439/609
5,035,652 7/1991 Shibano ..... 439/610
5,213,524 5/1993 Okamoto et al. ..... 439/607
5,281,169 1/1994 Kiat et al. ..... 439/607

FOREIGN PATENT DOCUMENTS 2150682 12/1990 Japan .

*Primary Examiner*—Hien Vu
*Attorney, Agent, or Firm*—Whitham, Curtis, Whitham & McGinn

[57] ABSTRACT

An electrical connector includes a box-shaped molded connector body having an inserting recess into which a mating connector is inserted, and a predetermined number of contact pins embedded therein, an outer shielding cover covering the outer surface of the connector body except the bottom surface and the inserting recess, and an inner shielding cover in the form of a tube rectangular in section which covers the inner surface of the inserting recess.

17 Claims, 9 Drawing Sheets

ELECTRICAL CONNECTOR

BACKGROUND OF THE INVENTION

1. Field of the Invention

This invention relates to a socket type electrical connector which includes: a molded connector body having an inserting recess into which a mating plug-type electrical connector is inserted, and a predetermined number of contact pins embedded therein; and a shield cover covering the molded connector body, and which connector is fixedly secured, for instance, to a wiring board built in an electronic apparatus.

2. Related Art

A typical example of an electrical connector of this type is as shown in FIGS. 15 through 20. The electrical connector 70 comprises a box-shaped molded connector body 71, and a shielding cover 80. The connector body 71 has an inserting recess 73 into which a mating plug-type electrical connector 90 (FIGS. 18 through 20) is inserted. As shown in FIG. 17, the connector body 71 has two guide pins 74 and a predetermined number of contact pins 75 (sixteen contact pins 75 in the connector shown in FIG. 17) which are embedded therein. The shielding cover 80 is fixedly secured to the connector body 71 in such a manner that it substantially covers the upper and right and left surfaces of the connector body 71.

The shielding cover 80, as shown in FIG. 16 which is an unfolding diagram of the shielding cover 80, comprises: a top plate 81 with two cantilevered contact tongue pieces 85 and 85 which are V-shaped in section; a pair of side plates 83 and 82 which are extended downwardly from the right and left ends of the top plate 81; and rear retaining plates 84*a*, 84*b* and 84*c* which are extended from the rear ends of the top plate 81 and the side plates 83 and 82, respectively. The top plate 81 has a pair of pit-like protrusions on its lower surface, and the side plates 82 and 83 have locking windows 82*a* and 83*a*, respectively. Those plates are bent through 90° along the one-dot chain lines in FIG. 16 to form the shielding cover 80. The shielding cover 80 thus formed is engaged with the connector body 71 from above in such a manner that the protrusions 89 and 89 of the top plate 81 are engaged with an engaging groove 79 formed in the connector body 71, and the locking windows 82*a* and 83*a* of the side plates 82 and 83 are engaged with fixing protrusions 76 and 76 formed on both side surfaces of the connector body 71. Thus, the shielding cover 80 has been fixedly secured to the connector body 71.

When the shielding cover 80 is combined with the connector body 71 in the above-described manner, the contact tongue pieces 85 and 85 of the shielding cover 80 are partially allowed to go into rectangular windows 77 and 77, respectively, which are formed in the upper surface of the connector body 71. Hence, when the mating connector 90 is inserted into the inserting recess 73 of the connector body 71, the contact tongue pieces 85 and 85 are elastically pushed against a shielding cover 95 mounted over the mating connector 90.

Hence, external noise is grounded through the shielding cover 95 of the mating connector 90, the contact tongue pieces 85, the shielding cover 80, legs 86 of the latter 80, a wiring board in an electronic apparatus which is connected to the connector 70 and the housing of the electronic apparatus.

In FIGS. 15 through 20, reference numerals 78 and 88 designate locking holes which are formed in the connector body 71 and the shielding cover 80, respectively. Those locking holes 78 and 88 are engaged with a locking protrusion 96 of the mating connector 90 to prevent the mating connector 90 from coming off the connector 70. The locking protrusion 96 of the mating connector 90 is so designed that it is moved in and out by operating an operating button 97.

In the above-described electrical connector 70, the shielding cover 80 covers the connector body 71. The contact tongue pieces 85 and 85 bent downwardly are extended through the upper wall of the connector body 71 into the inside of the connector body 71 so that the shielding cover 80 of the connector 70 is electrically conducted to the shielding cover 95 of the mating connector 90.

However, the conventional electrical connector 70 thus constructed is disadvantageous in the following points:

(1) The connector 70 is not sufficiently shielded, because the shielding cover 80 covers only the top and right and left sides of the connector body 71.

(2) There are gaps around the contact tongue pieces 85 and 85. Hence, not only dust but also radiation noise may go into the connector 70 through the gaps.

(3) In order to overcome the difficulty described in the above paragraph (1), instead of the U-shaped shielding cover, a box-shaped shielding cover has been proposed in the art. However, the box-shaped shielding cover gives rise to another problem. That is, in the case where the box-shaped shielding cover is formed merely by bending a metal plate, the front end portion of the connector where the connector inserting recess opens may be deformed when the mating connector 90 is engaged with or disengaged from the connector 70.

(4) The shielding cover 80 has only two contact tongue pieces 85 and 85 in its upper plate. This means that the number of electrical contact points and the electrical contact area of the connector 70 are both small; that is, the connector 70 is relatively low in electrical conductivity with the shielding cover of the mating connector.

SUMMARY OF THE INVENTION

In view of the foregoing, an object of the invention is to provide an electrical connector which is sufficiently shielded from radiation noise, and is scarcely deformed.

Another object of the invention is to provide an electrical connector which is sufficiently shielded from radiation noise, and is satisfactorily electrically conducted to the shielding cover of the mating connector.

According to an aspect of the present invention, there is provided an electrical connector comprising:

a box-shaped molded connector body which has an inserting recess into which a mating connector is inserted, and a predetermined number of contact pins embedded therein;

an outer shielding cover which covers the outer surface of the connector body except the bottom surface and the inserting recess;

an inner shielding cover in the form of a tube rectangular in cross-section which covers the inner surface of the inserting recess, the inner shielding cover having contact tongue pieces on the upper, lower, right and left walls thereof which are elastically pushed against the outer surface of the mating connector.

In another aspect of the present invention, there is provided an electrical connector comprising:

a box-shaped molded connector body which has an inserting recess into which a mating connector is inserted, and a predetermined number of contact pins embedded therein;

an outer shielding cover which covers the outer surface of the connector body except the bottom surface and the inserting recess;

an inner shielding cover in the form of a tube rectangular in section which covers the inner surface of the inserting recess, the outer shielding cover including a top plate, a pair of side plates which are extended downwardly from the right and left ends of the top plate, respectively, a rear plate which is extended downwardly from the rear end of the top plate;

a front plate which is extended downwardly from the front end of the top plate, and has an inserting opening, both end portions of the front plate are bent over the pair of side plates, respectively, being locked to the side plates by male-female engagement.

The electrical connector of the invention may be designed such that outer shielding cover has a fixing connection tongue piece which is extended upwardly from one end of a top plate forming the outer shielding cover, and the inner shielding cover has a fixing connection tongue piece which is extended upwardly from one end of a top wall forming the inner shielding diver. Those tongue pieces are set aligned with each other and secured, for instance, to the housing of an electronic apparatus.

Furthermore, the outer shielding cover may comprise: a top plate, a pair of side plates which are extended downwardly from the right and left ends of the top plate, respectively, a rear plate which is extended downwardly from the rear end of the top plate; and a front plate which is extended downwardly from the front end of the top plate, and has an inserting opening. The outer shielding cover is put over the connector body from above in which the inner shielding cover has been fitted, in such a manner that the front surface of the fixing connection tongue piece of the outer shielding cover is confronted with the rear surface of the fixing connection tongue piece of the inner shielding cover.

When, in assembling the electrical connector of the invention, both end portions of the front plate are bent over the pair of side plates, preferably they are locked to the side plates near the bottom of the outer shielding cover by male-female engagement.

In addition, in the electrical connector, preferably the end portions of the front plate which are bent over the pair of side plates have locking windows such as dowel holes, respectively, and the side plates have small protrusions such as dowels which are engaged with the locking windows, respectively.

In the electrical connector of the invention thus constructed, the outer and inner surfaces of the molded connector body are covered with the outer and inner shielding covers, respectively. Hence, the electrical connector of the invention is more positively shielded than the conventional electrical connector in which the connector body is covered with one U-shaped (outer) shielding cover. Furthermore, in the electrical connector of the invention, the connector body is covered with the two shielding covers. Hence, in the electrical connector of the invention, it is unnecessary for the outer shielding cover to have contact tongue pieces such as those in the conventional electrical connector, which makes it possible to cover the outer surface of the molded connector body without formation of gaps and to prevent the entrance of dust or external noise into the connector.

In the connector of the invention, the upper, lower, right and left walls of the inner shielding cover have the contact tongue pieces, which increase the number of contact points and the contact area through which the inner shielding cover is brought into electrical contact with the outer shielding cover. Hence, the inner shielding cover is more positively brought into contact with the outer shielding cover; in other words, the inner shielding cover is electrically conducted to the outer shielding cover with high reliability.

The outer shielding cover has the fixing connection tongue piece which is extended upwardly from one end of the top plate of the outer shielding cover, and the inner shielding cover also has a fixing connection tongue piece which is extended upwardly from one end of the top wall of the inner shielding cover, the tongue pieces are aligned with each other and secured, for instance, to the housing of an electronic apparatus with a screw. Hence, the outer shielding cover is positively electrically conducted to the inner shielding cover, so that external noise is grounded through the housing. At the same time, the connector can be positively fastened to the housing of an electronic apparatus or the like with the tongue pieces.

Furthermore, in the electrical connector, the outer shielding cover includes the top plate, the pair of side plates which are extended downwardly from the right and left ends of the top plate, respectively, the rear plate which is extended downwardly from the rear end of the top plate; and the front plate which is extended downwardly from the front end of the top plate, and has the inserting opening. Both end portions of the front plate are bent over the pair of side plates, and locked to the side plates by male-female engagement. Hence, the front plate with the inserting opening is fixedly secured to the side plates; that is, those plates are substantially prevented from rattling. Accordingly, even if the mating connector is frequently inserted into the connector through the front plate, the front plate having the inserting opening is scarcely deformed, and the connector also is scarcely deformed.

Furthermore, when both end portions of the front plate are bent over the pair of side plates, the end portions are locked to the side plates near the bottom of the outer shielding cover by male-female engagement. Hence, even if the mating connector is frequently inserted into the connector through the inserting opening of the front plate, the front plate is scarcely deformed.

DETAILED DESCRIPTION OF THE PREFERRED EMBODIMENT

Preferred embodiments of the invention will be described with reference to the accompanying drawings.

Figure 1:
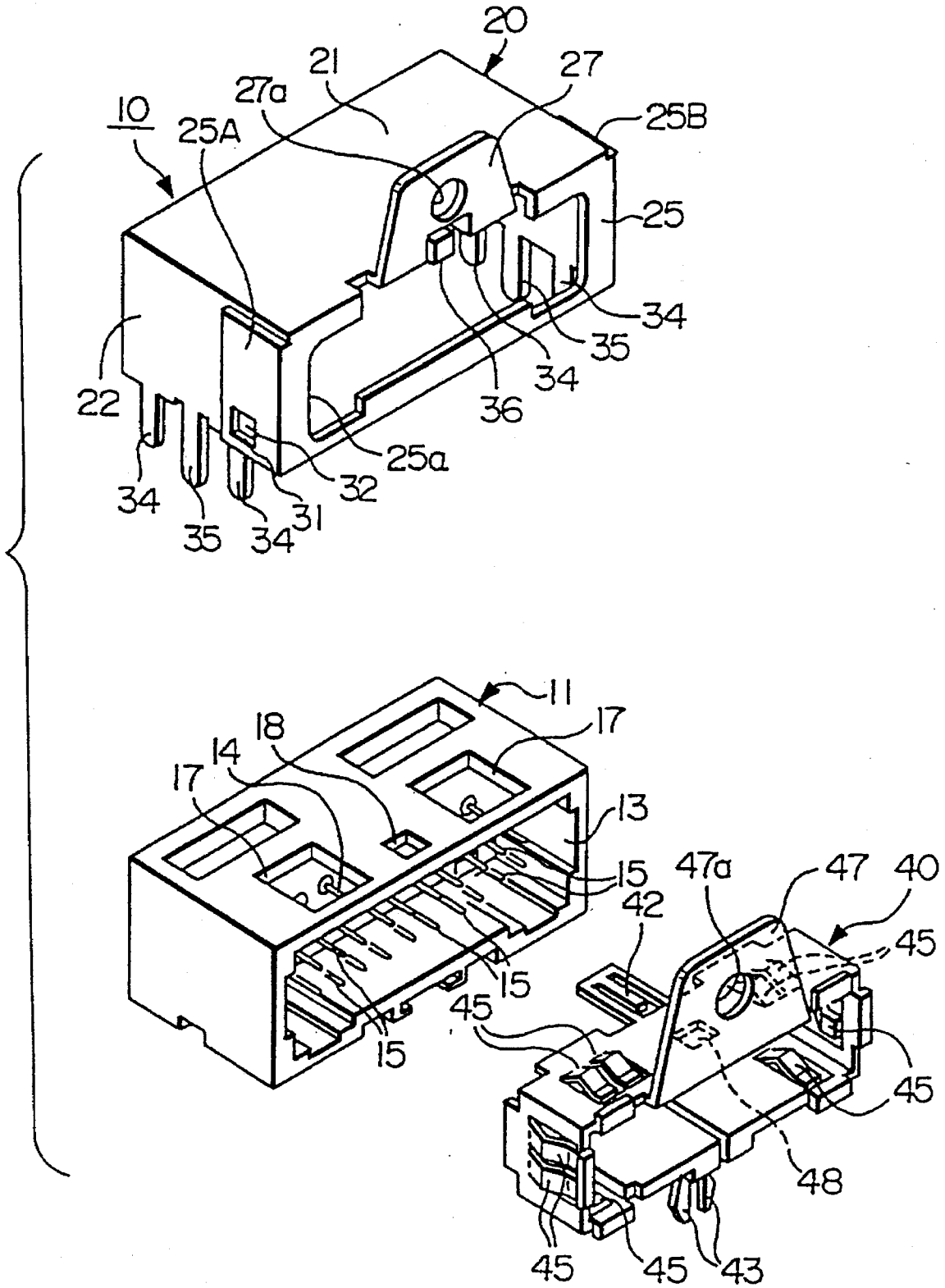
FIG. 1 is an exploded perspective view of an electrical connector, which constitutes a first embodiment of the invention.
Figure 2:
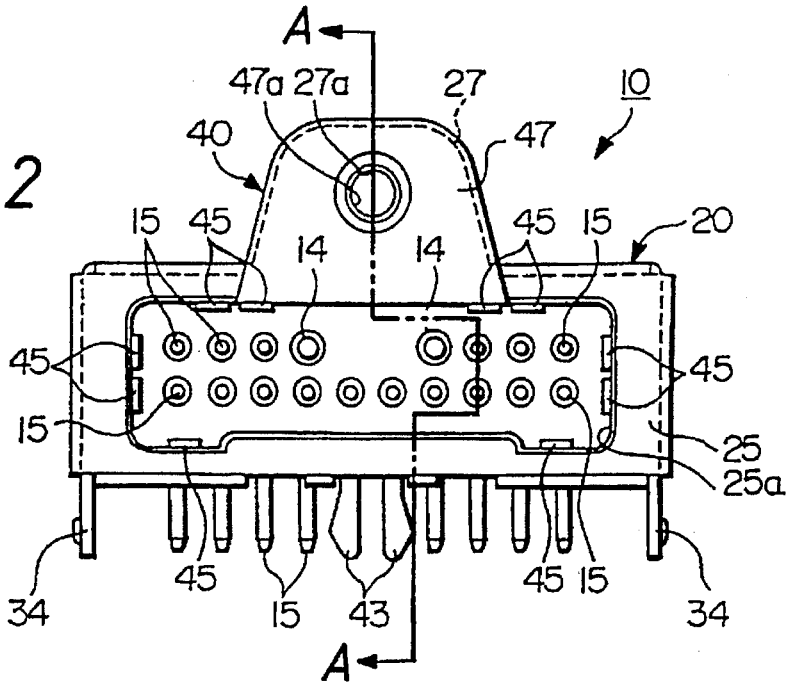
FIG. 2 is a front view of the electrical connector of the invention.
Figure 3:
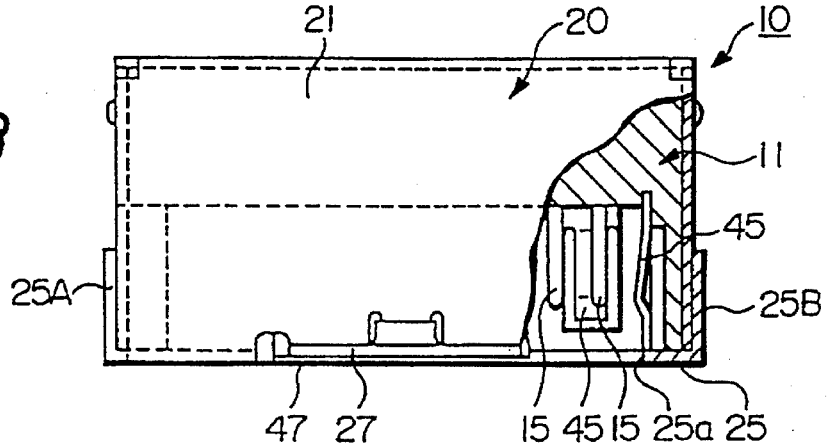
FIG. 3 is a plan view, with parts cut away, of the electrical connector shown in FIG. 2.
Figure 4:
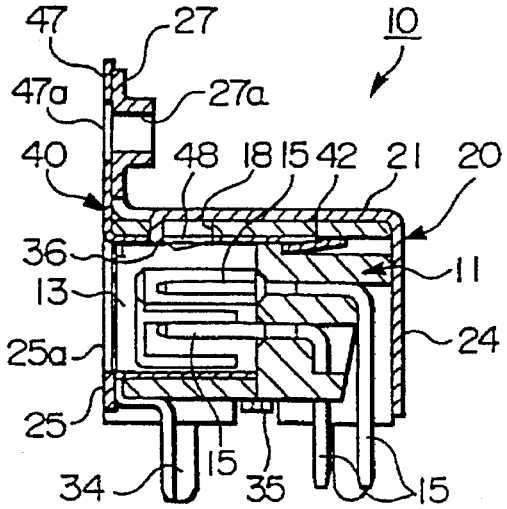
FIG. 4 is sectional view taken along line A—A in FIG. 2.
Figure 5:
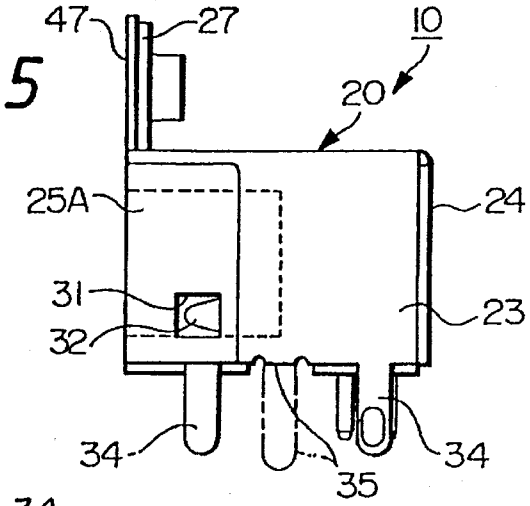
FIG. 5 is a side view of the electrical connector shown in FIG. 2.

FIG. 1 is an exploded perspective view of an electrical connector, which constitutes a first embodiment of the invention. As shown in FIG. 1, the electrical connector 10 comprises: a molded connector body 11; an outer shielding cover 20; and an inner shielding cover 40.

Figure 18:
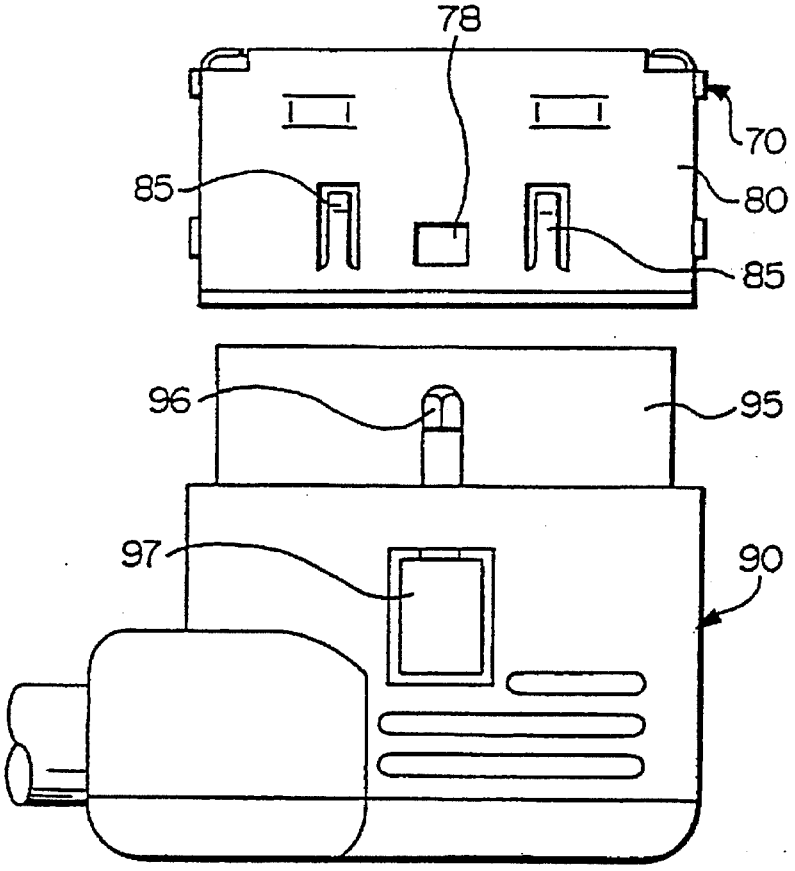
PRIOR ART FIG. 18
FIG. 18 is a plan view showing the conventional electrical connector and its mating connector.
Figure 19:
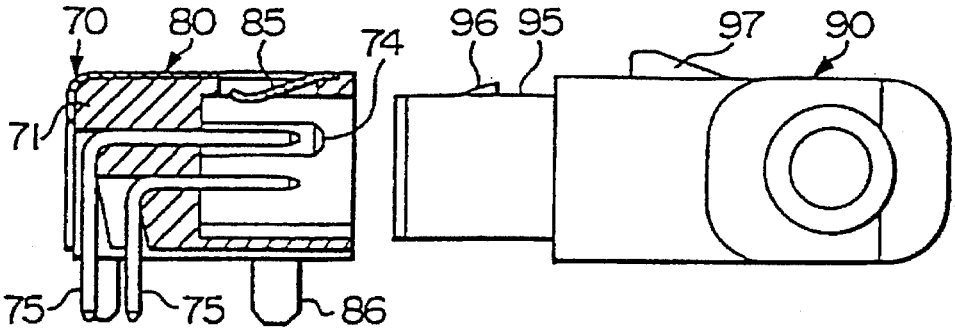
PRIOR ART FIG. 19
FIG. 19 is a longitudinal sectional diagram of the conventional electrical connector shown together with the mating connector.
Figure 20:
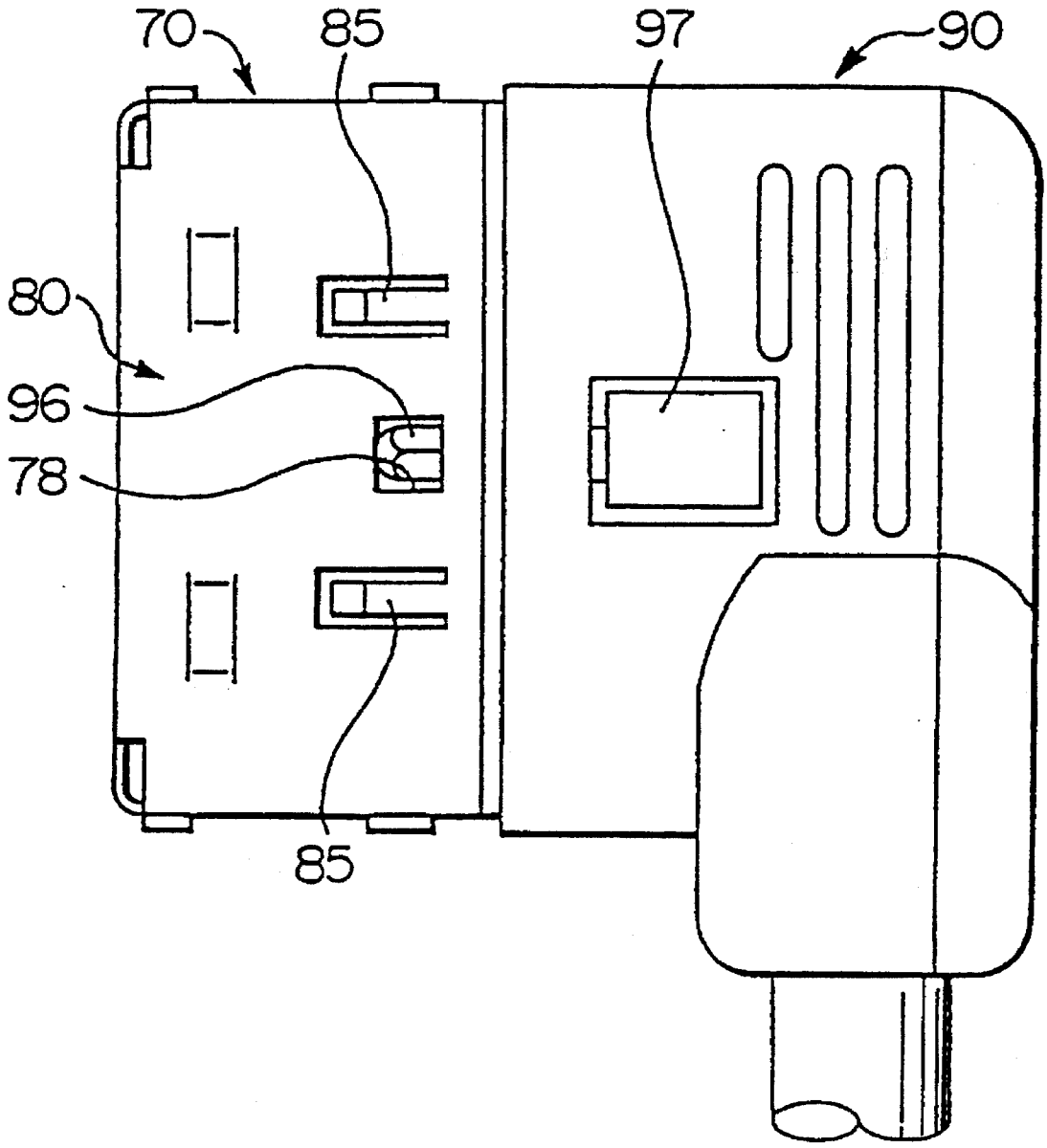
PRIOR ART FIG. 20
FIG. 20 is a plan view of the conventional electrical connector engaged with the mating connector.

The connector body 11 is in the form of a box having an inserting recess 13 into which a mating connector 90 (equal to the mating connector shown in FIG. 18) is inserted. As is seen from FIGS. 2 through 5, the connector body 11 has two guide pins 14 and a predetermined number of contact pins 15 (sixteen contact pins 75 in FIG. 1) which are embedded in the inserting recess. The connector body 11 has rectangular windows 17 and 17 in the upper wall through which appear contact tongue pieces 45 of the inner shielding cover 40 (described later). In addition, a locking hole 18 is formed in the upper wall of the connector body 11.

Figure 6:
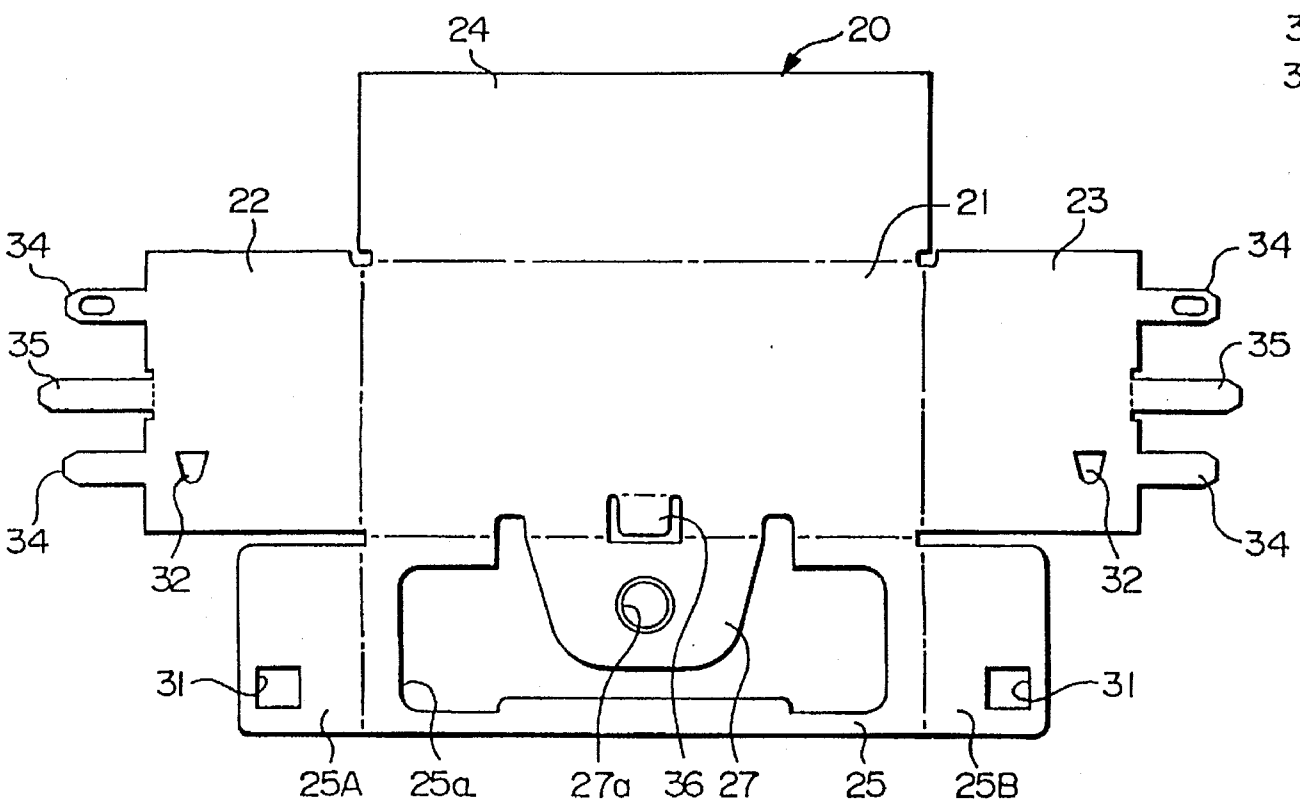
FIG. 6 is an unfolding diagram of a plate material which is to be formed into an outer shielding cover which is a part of the electrical connector.
Figure 7:
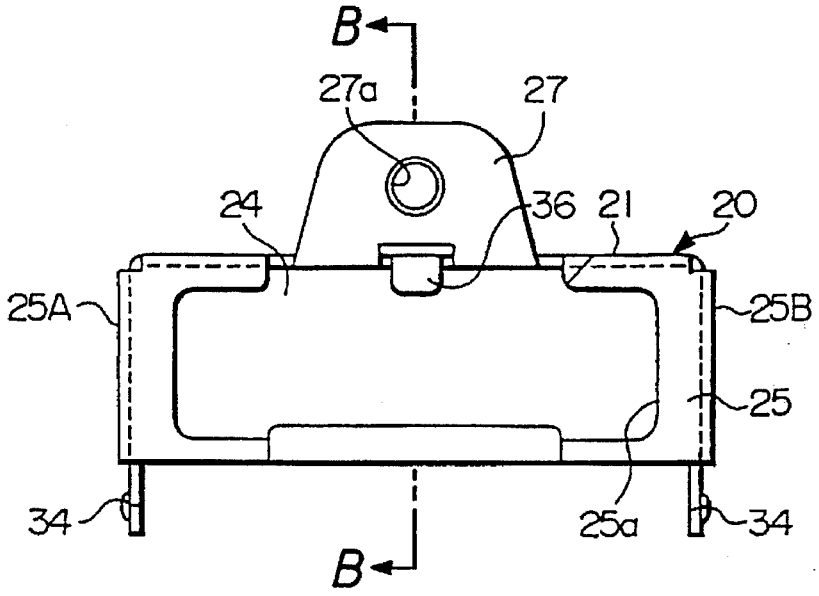
FIG. 7 is a diagram showing the outer shielding cover which has been formed by using the plate material shown in FIG. 6.
Figure 8:
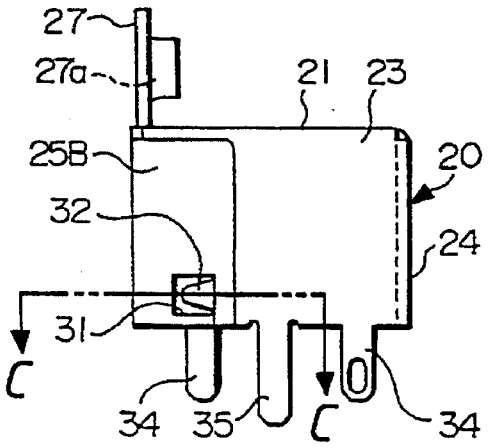
FIG. 8 is a side view of the outer shielding cover shown in FIG. 7.
Figure 10:
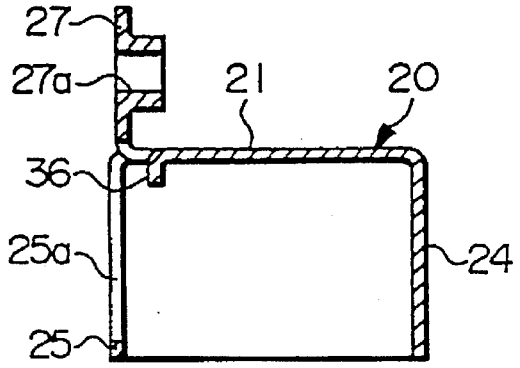
FIG. 10 is a sectional view taken along line B—B in FIG. 7.
Figure 11:
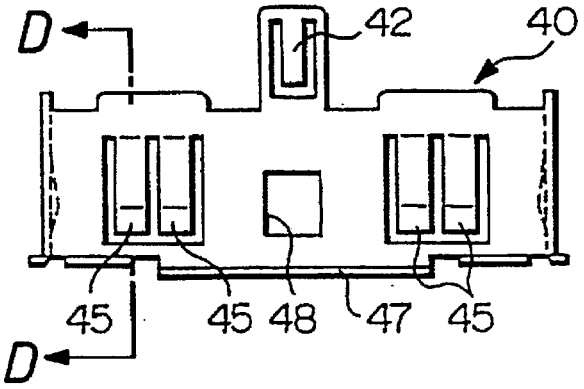
FIG. 11 is a plan view of an inner shielding cover which is a part of the electrical connector.
Figure 12:
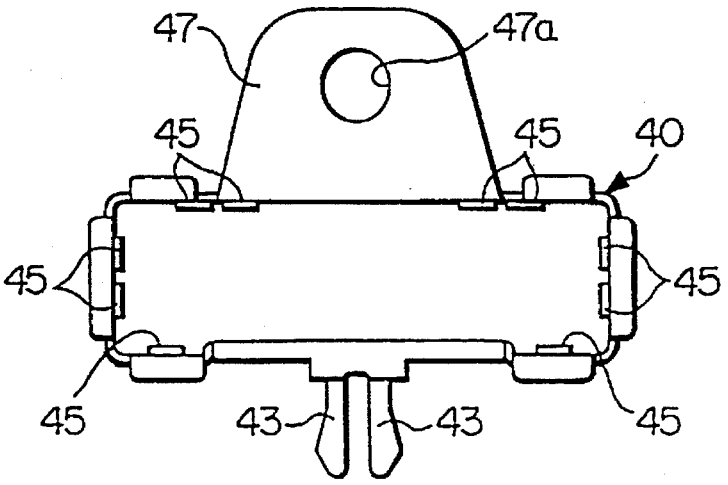
FIG. 12 is a front view of the inner shielding cover shown in FIG. 11.
Figure 13:
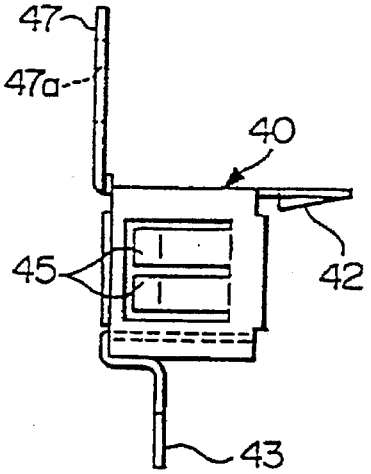
FIG. 13 is a side view of the inner shielding cover shown in FIG. 11.

The outer shielding cover 20 is in the form of a box made of a steel plate. The shielding cover 20 covers the outer surface of the connector body 11 except the bottom surface and the inserting recess 13. FIG. 6 is an unfolding diagram of the outer shielding cover 20, and FIGS. 7, 8 and 10 are a front view, a side view and a sectional view of the shielding cover 20, respectively. As is apparent from those figures, the outer shielding cover 20 comprises: a top plate 21; a pair of side plates 23 and 22 which are extended downwardly from the right and left ends of the top plate 21, respectively; a rear plate 24 which is extended downwardly from the rear end of the top plate 21; a front plate 25 which is extended downwardly from the front end of the top plate 21 and has an inserting opening 25*a;* and a fixing connection tongue piece 27 which is extended upwardly from the front end of the top plate 21 and has a screw inserting hole 27*a* with a boss.

Figure 9:
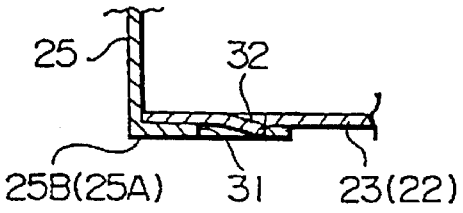
FIG. 9 is an enlarged sectional view taken along line C—C in FIG. 8.

A pair of side bend plates 25B and 25A are extended from the right and left ends of the front plate 25, respectively, and are bent 90° so that they are laid over the aforementioned side plates 23 and 22, respectively, in such a manner that the side bend plates 25B, 25A are locked to the side plates 23, 22. More specifically, the side bend plates 25A and 25B have rectangular locking windows (dowel holes) 31 in the lower outer corners, while small protrusions (dowels) 32 and 32 are formed on the side walls 22 and 23 so that they are engaged with the locking windows 31 and 31. As is seen from FIG. 9 which is a sectional view taken along line C—C in FIG. 8, when the side bend plates 25A and 25B are bent over the side plates 22 and 23, respectively, the small protrusions 32 and 32 are fixedly engaged with the locking windows 31 and 31, respectively.

Each of the side plates 22 and 23 has two legs 34 which are inserted into the wiring board, and a fixing leg 35 which is bent to secure the outer shielding cover to the connector body 11. The top plate 21 of the outer shielding cover 20 has a locking tongue piece 36 which is bent downwardly. The tongue piece 36 is engaged with a locking hole 18 formed in the connector body 11 and a locking hole 48 formed in the inner shielding cover 40 (described later).

Figure 14:
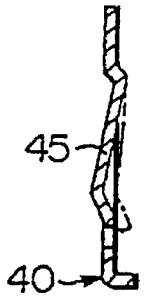
FIG. 14 is an enlarged sectional view taken along line D—D in FIG. 11.
Figure 15:
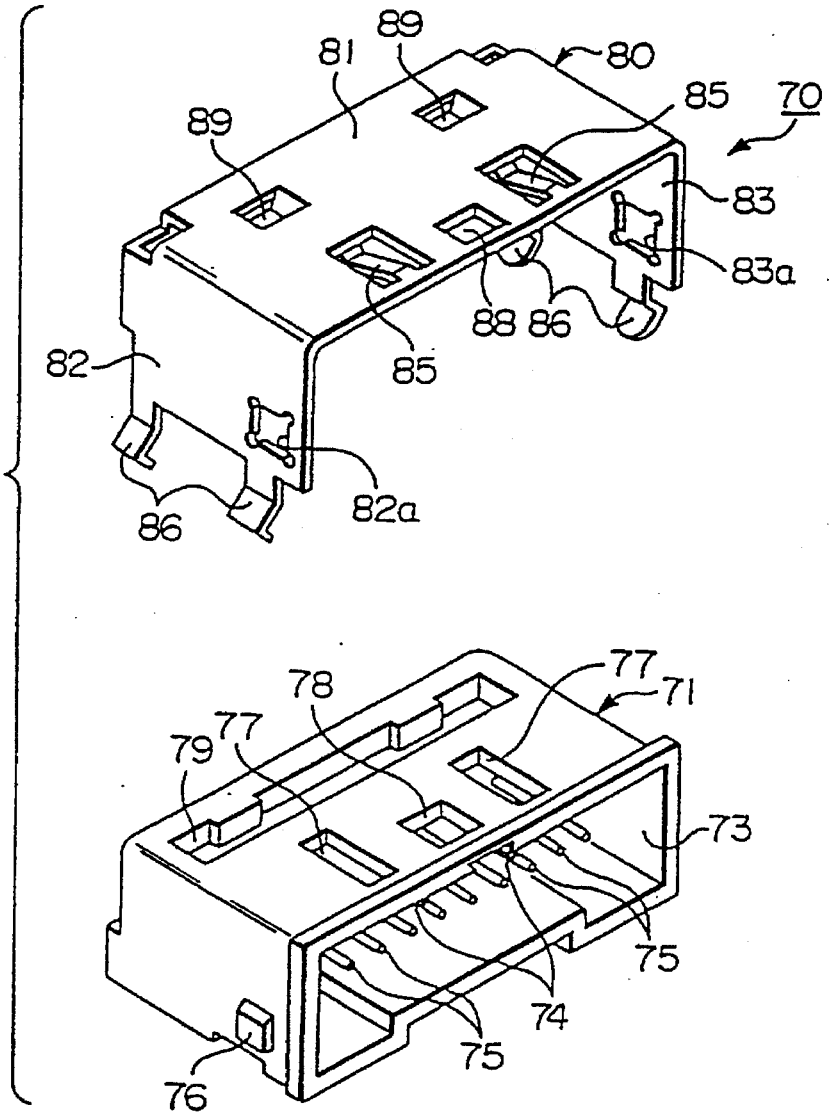
FIG. 15 PRIOR ART
FIG. 15 is an exploded perspective view showing an example of a conventional electrical connector.
Figure 16:
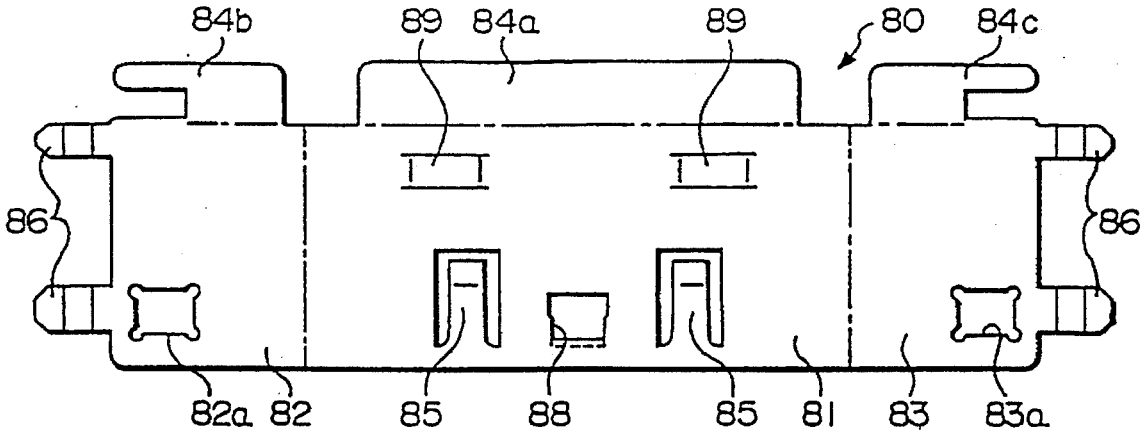
PRIOR ART FIG. 16
FIG. 16 is an unfolding diagram of an outer shielding cover which is a part of the conventional electrical connector.
Figure 17:
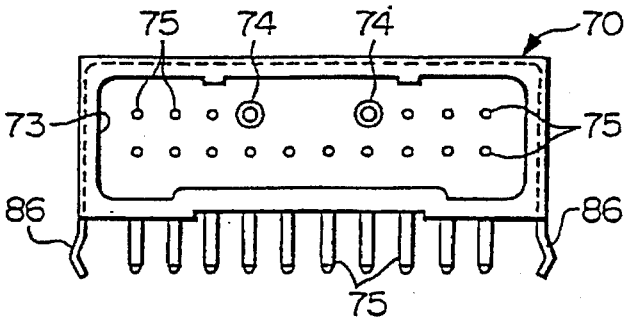
PRIOR ART FIG. 17
FIG. 17 is a front view of the conventional electrical connector.

The inner shielding cover 40 is made of a metal plate of copper alloy. As is apparent from FIGS. 1 and 11 through 14, the inner shielding cover 40 is in the form of a tube rectangular in section. The inner shielding cover 40 is inserted into the connector body 11 through the inserting opening 13 to cover the inner surfaces of the connector body 11. The inner shielding cover 40 has a plurality of cantilevered contact tongue pieces 45 which are inverted-V-shaped in section in the top, bottom, right and left walls (cf. FIG. 14) (ten contact tongue pieces 45—two pairs of tongue pieces 45 in the upper wall, one pair of tongue pieces 45 in each of the right and left walls, and two tongue pieces 45 in the bottom wall).

The bottom wall of the inner shielding cover 40 has a pair of legs which are inserted into the wiring board. A locking tongue piece 42 is extended from the rear end of the top wall of the inner shielding cover 40 which, when the inner shielding cover 40 is fitted in the connector body 11, prevents the inner shielding cover from coming off the connector body 11 (cf. FIG. 4).

The inner shielding cover 40 also has a fixing connection tongue piece 47 which is extended upwardly from the top wall. The fixing connection tongue piece 47 has a screw inserting hole 47*a*. The tongue piece 47 of the inner shielding cover 40 and the tongue piece 27 of the outer shielding cover 20 are aligned with each other and secured, for instance, to the housing of an electronic apparatus with a screw.

In the embodiment, the outer shielding cover 20 is put over the connector body 11 from above in which the inner shielding cover 40 has been fitted. When the outer shielding cover 20 covers the connector body 11 in the above-described manner, the front surface of the fixing connection tongue piece 27 of the outer shielding cover 20 is confronted with the fixing connection tongue piece 47 of the inner shielding cover 40 (cf. FIG. 4), so that those tongue pieces 27 and 47 are positively pushed against each other.

The electrical connector 10 thus designed is assembled as follows: The inner shielding cover 40 is fitted into the connector body 11, and then the outer shielding cover 20 is mounted over the connector body 11 from above so that it covers the connector body 11. Thereafter, the fixing legs 35 of the outer shielding cover 20 are bent to secure the shielding cover 20 to the connector body 11 (cf. FIGS. 4 and 5).

When the outer shielding cover 20 is mounted over the connector body 11 in which the inner shielding cover 40 has been fitted in the above-described manner; that is, when the connector 10 is assembled, the contact tongue pieces 45 of the inner shielding cover 40 are held protruded inside the connector body 11. Hence, when the mating connector 90 is inserted into the inserting recess 13 of the connector body 11, the contact tongue pieces 45 are elastically brought into contact with the shielding cover 95 of the mating connector 90.

Hence, external noise is grounded through the shielding cover 95 of the mating connector 90, the contact tongue pieces 45, the inner shielding cover 40, and the legs 43 of the inner shielding cover 40, or through the fixing connection tongue piece 47 of the inner shielding cover 40, the fixing connection tongue piece 27 of the outer shielding cover 20 which is in contact with the tongue piece 47, the outer shielding cover 20, the screw screwed into those tongue pieces 27 and 47, the housing of the electronic apparatus which is in contact with the tongue pieces 27 and 47, the legs 34 of the outer shielding cover 20, and the wiring board built in the electronic apparatus into which the legs 34 are inserted.

The locking protrusion 96 of the mating connector 90 is engaged with the locking holes 18 and 48 which are formed in the connector body 11 and the inner shielding cover 40, respectively, so that the mating connector 90 is fixedly coupled to the connector 10. The locking protrusion 96 can be moved in and out by operating an operating button 97.

As was described above, in the electrical connector of the invention, the inner surface of the connector body 11 is covered with the inner shielding cover 40, and the outer surface with the outer shielding cover 20. Therefore, the electrical connector of the invention is much higher in shielding effect than the conventional one in which the connector body is covered with the U-shaped shielding cover 80 only (corresponding to the outer shielding cover of the connector of the invention) which is U-shaped in section.

Since the electrical connector has two shielding covers, it is unnecessary for the connector to have contact means such as the contact tongue pieces 85 of the conventional electrical connector. Therefore, the outer surface of the connector body can be covered without formation of gaps, and dust and radiation noise are prevented from entering the connector;

The upper, lower, right and left walls of the inner shielding cover 40 have the contact tongue pieces 45, which increase the number of contact points and the contact area through which the inner shielding cover 40 is brought into electrical contact with the outer shielding cover 95 of the connector 90. Hence, the inner shielding cover 40 is more positively brought into contact with the outer shielding cover 95; in other words, the inner shielding cover 40 is electrically conducted to the outer shielding cover 95 with high reliability.

The outer shielding cover 20 has the fixing connection tongue piece 27 which is extended upwardly from the top plate 21, and the inner shield cover 40 also has the fixing connection tongue piece 47 which is extended upwardly from the top wall. Those fixing connection tongue pieces 27 and 47 are aligned with each other and secured, for instance, to the housing of an electronic apparatus with the screw. Hence, the outer shielding cover 20 and the inner shielding cover 40 are positively electrically conducted to each other, as a result of which external noise is positively grounded through the housing. In addition, the electrical connector is positively secured to the housing.

The outer shielding cover, as was described above, comprises: the top plate 21; one pair of side plates 23 and 22 which are extended downwardly from the right and left ends of the top plate 21, respectively; the rear plate 24 which is extended downwardly from the rear end of the top plate 21; and the front plate 25 which is extended downwardly from the front end of the top plate 21 and has the inserting opening **25*a*. Both end portions of the front plate 25, namely, the side bend plates 25A and 25B are bent over the pair of side plates 22 and 23, so that the side bend plates 25A and 25B are fixedly locked to the side plates 22 and 23 by male-female engagement; i.e., with the locking windows (dowel holes) being engaged with the small protrusions (dowels) 32. Thus, the front plate 25 with the inserting opening 25*a* is fixedly secured to the side plates 22 and 23; that is, those plates 25, 22 and 23 are substantially prevented from rattling. Accordingly, even if the mating connector is frequently inserted into the connector 10 through the inserting opening of the front plate 25, the front plate 25 is scarcely deformed, and the connector 10** also is scarcely deformed.

The side bend plates 25A and 25B have the locking windows (dowel holes) 31 near the bottom, while the side plates 22 and 23 also have the small protrusions (dowels) 32 so that the latter are engaged with the locking windows. That is, the side bend plates are locked to the side plates by male-female engagement. Hence, even if a great force acts on the lower end of the front plate having the connector inserting opening 25, the outer shielding cover is scarcely deformed.

As is apparent from the above description, the electrical connector of the invention is sufficiently shielded from radiation noise, and can be electrically conducted to the mating connector with high reliability. In addition, in the electrical connector of the invention, its components are scarcely deformed even if a great force is applied thereto. Those effects should be highly appreciated in practical use.

What is claimed is:

1. An electrical connector comprising:

a box-shaped molded connector body having an inserting recess into which a mating connector is inserted, and a plurality of contact pins embedded therein;

an outer metal shielding cover covering an outer surface of said connector body except a bottom surface and said inserting recess, wherein an outer surface of said outer metal shielding cover comprising a continuous surface such that an outer surface of said molded connector body is covered without formation of any gaps; and a rectangular inner metal shielding cover for covering an inner surface of said inserting recess and said plurality of contact pins, such that said plurality of contact pins are shielded by both said outer metal shielding cover and said inner metal shielding cover, wherein said outer metal shielding cover includes first and second side plates, each including a first leg for insertion into a wiring board and a second leg for securing to said molded connector body.

2. An electrical connector as claimed in claim 1, wherein said outer metal shielding cover includes:

a top plate;

a pair of side plates extending downwardly from right and left ends of said top plate, respectively;

a rear plate extending downwardly from a rear end of said top plate; and a front plate extending downwardly from a front end of said top plate, and having an inserting opening.

3. An electrical connector as claimed in claim 2, wherein both end portions of said front plate are bent over said pair of side plates, respectively, and locked to said side plates.

4. An electrical connector as claimed in claim 2, wherein when both end portions of said front plate are bent over said pair of side plates, said end portions are locked to said side plates near a bottom of said outer metal shielding cover.

5. An electrical connector as claimed in claim 2, wherein both end portions of said front plate which are bent over said pair of side plates include locking windows, respectively, and said pair of side plates include protrusions for engaging said locking windows, respectively.

6. An electrical connector as claimed in claim 4, wherein both end portions of said front plate which are bent over said pair of side plates include locking windows, respectively, and said pair of side plates include protrusions which are engaged with said locking windows, respectively.

7. An electrical connector as claimed in claim 1, wherein said inner metal shielding cover includes contact tongue pieces on upper, lower, right and left walls thereof which are elastically pushed against the outer surface of said mating connector.

8. An electrical connector as claimed in claim 1, wherein said outer metal shielding cover includes a fixing connection tongue piece which is extended upwardly from one end of a top plate forming said outer metal shielding cover, said inner shielding cover including a fixing connection tongue piece which is extended upwardly from one end of a top wall forming said inner metal shielding cover, and wherein said tongue pieces are secured to the housing of an electronic apparatus after said tongue pieces are aligned with each other.

9. An electrical connector as claimed in claim 8, wherein when said outer metal shielding cover is mounted over said connector body from above in which said inner metal shielding cover has been fitted, a front surface of said fixing connection tongue piece of said outer metal shielding cover is confronted with a rear surface of said fixing connection tongue piece of said inner metal shielding cover.

10. An electrical connector according to claim 1, wherein all outer walls of said inner metal shielding cover include contact tongue members for electrically contacting said outer shielding cover.

11. An electrical connector according to claim 1, wherein said inner metal shielding cover comprises a plate formed of a copper alloy.

12. An electrical connector according to claim 1, wherein said outer metal shielding cover includes a tongue piece and said inner metal shielding cover includes a tongue piece aligned with that of said outer metal shielding cover.

13. An electrical connector according to claim 1, wherein said inner metal shielding cover is for insertion into said connector body, said inner metal shielding cover including a locking tongue piece extended from a rear end of a top wall thereof, said locking tongue piece for preventing said inner metal shielding cover from disengaging from said connector body.

14. An electrical connector according to claim 1, wherein said outer metal shielding cover includes a top plate having a continuous surface without any openings formed therein, and first and second side plates having a surface without any openings formed therein.

15. An electrical connector according to claim 1, wherein said inner metal shielding cover comprises a metal plate formed of a copper alloy and wherein said outer shielding cover includes a tongue piece and said inner metal shielding cover includes a tongue piece aligned with that of said outer metal shielding cover.

16. An electrical connector according to claim 1, wherein said inner metal shielding cover is for insertion into said connector body, wherein said inner metal shielding cover includes a locking tongue piece extended from a rear end of a top wall thereof, said locking tongue piece for preventing said inner metal shield cover from disengaging from said connector body, and wherein said outer metal shielding cover includes a top plate having a continuous surface without any openings formed therein, and first and second side plates having a surface without any openings formed therein.

17. An electrical connector according to claim 3, wherein all outer walls of said inner metal shielding cover include contact tongue members for electrically contacting said outer metal shielding cover.

* * * * *